United States Patent [19]

Yasuda et al.

[11] Patent Number: 5,019,460

[45] Date of Patent: May 28, 1991

[54] GALVANNEALED STEEL SHEET HAVING IMPROVED SPOT-WELDABILITY

[75] Inventors: Akira Yasuda; Hideo Koumura; Koji Yamato; Koichi Yasuda, all of Chiba, Japan

[73] Assignee: Kawasaki Steel Corporation, Kobe, Japan

[21] Appl. No.: 454,515

[22] Filed: Dec. 21, 1989

[51] Int. Cl.[5] ..... B32B 15/00

[52] U.S. Cl. ..... 428/659; 427/123

[58] Field of Search ..... 428/659; 427/123

[56] References Cited

U.S. PATENT DOCUMENTS 4,759,807 7/1988 Sippola ..... 148/156

4,851,054 7/1989 Fukuzuka ..... 148/12.3

*Primary Examiner*—Peter D. Rosenberg

*Attorney, Agent, or Firm*—Dvorak and Traub

[57] ABSTRACT

A galvannealed steel sheet having a superior spot weldability characteristic in which the steel sheet has a base steel sheet cold-rolled from a material containing 0.005 wt % or less of C, 0.005 to 0.05 wt % of Ti, 0.01 to 0.1 wt % of Al, 0.005 to 0.015 wt % of Nb and 0.0002 to 0.002 wt % of B. In the process for making, the hot-dip plating layer applied after the alloying heat treatment has an Fe content of from 9 wt % to 12 wt %.

2 Claims, No Drawings

GALVANNEALED STEEL SHEET HAVING IMPROVED SPOT-WELDABILITY

BACKGROUND OF THE INVENTION

1. Field of the Invention

The present invention relates to a galvannealed steel sheet, suitable for producing body parts of automobiles. The invention is also concerned with a method of producing it.

2. Description of the Related Art

Galvannealed Steel sheets exhibit superior corrosion resistance and, hence, are broadly used as the material of automobile body parts. Materials of automobile body parts are required to have corrosion resistance property as well as other characteristics such as press-workability, resistance to peeling of plating layer during press work, and spot-weldability.

In general, a continuous hot dip galvannealing process does not allowed a lengthy time period for heating and soaking. Therefore, in the production of plates steel sheets for automobile body parts which are required to have high press-workability, steel sheets having very low carbon content, which generally exhibit excellent press-workability with short heating and annealing, are used as the base materials, as disclosed, for example, in Japanese Patent Publication No. 60-48571.

However, galvannealed steel sheets having very low carbon content, exhibit inferior spot-weldability characteristics for reasons which will be explained later. The result is that the efficiency of the automobile body assembly process is seriously impaired.

In order to obviate these problems, it has been proposed to increase the Fe content in the plating layer or to coat the surface of the plating layer with a ferrous alloy. The first-mentioned method, however, is disadvantageous in that exfoliation or peeling of the plating layer tends to occur when the Fe content is increased to a level which provides the desired level of spot-weldability. On the other hand, the second-mentioned method causes the production cost to be raised seriously and reduces corrosion resistance after painting.

SUMMARY OF THE INVENTION

Accordingly, an object of the present invention is to provide a galvannealed steel sheet which employs, as the base sheet material, a steel sheet having very low carbon content which exhibits superior press-workability and which exhibits improved resistance to exfoliation or peeling of the plating layer during press-work, as well as superior spot-weldability in terms of spot welding at successive spots, thereby overcoming the above-described problems of the prior art.

To this end, according to one aspect of the present invention, there is provided a galvannealed steel sheet having superior spot-weldability, comprising a cold rolled base steel sheet having a composition consisting essentially of 0.005 wt% or less of C, 0.005 to 0.05 wt% of Ti, 0.01 to 0.1 wt% of Al, 0.005 to 0.015 wt% of Nb and 0.0002 to 0.002 wt% of B, and a hot-dip galvannealed layer containing 9 to 12 wt% of Fe.

According to another aspect of the present invention, there is provided a method of producing a galvannealed steel sheet having superior spot-weldability, comprising the steps of: producing a cold rolled steel sheet containing 0.005 wt% or less of C, 0.005 to 0.05 wt% of Ti, 0.01 to 0.1 wt% of Al, 0.005 to 0.015 wt% of Nb and 0.0002 to 0.002 wt% of B, annealing said base steel sheet at a temperature ranging between 770° and 900° C.; rapidly cooling the annealed sheet to a temperature ranging between 380° C. and 530° C. at a cooling rate of 10° C./sec or greater; dipping said base steel sheet in a hot melt of plating zinc having an Al content of 0.13 wt% or greater so as to form a plating layer; and effecting an alloying heat-treatment on said plating layer to obtain an Fe content ranging between 9 and 12 wt% in said plating layer.

The present inventors have found that the inferior spot-weldability in terms of welding at successive welding spots exhibited by galvannealed steel sheet is attributable to the following facts. Steel having very small carbon content is drastically softened by heating as compared with ordinary low-carbon steels. Therefore, the area of contact between the electrode and the plate surface is increased when spot welding is conducted and, in addition, the reaction between the electrode and zinc is promoted to deteriorate the state of end of the electrode.

Therefore, in order to produce a galvannealed steel sheet having a good press-workability and spot-weldability characteristic, it is advantageous to use a steel sheet which is soft enough at normal temperature to exhibit excellent press-workability and which is less liable to be softened when heated.

The base steel sheet used in the present invention has been developed from the above-described point of view. A description will be given of the reasons of limitation of the contents of the respective components of the steel.

C is an element which adversely affects press-workability. The C content, therefore, should be not greater than 0.005 wt%, in order to obtain a steel sheet having excellent press-workability under a condition where heating and soaking have to be done in short time as in the case of annealing in a continuous hot-dip galvanizing process.

Ti is an element which reacts with inevitably existing elements such as N and C so as to form TiN and TiC, thereby fixing such elements, thus eliminating any undesirable effect of such elements on press-workability, and thus enhancing the effect of B which will be mentioned later. In order to attain an appreciable effect of addition of Ti, the Ti content should be at least 0.005 wt%. On the other hand, however, addition of Ti in excess of 0.05 wt% causes burning defects in galvannealing process. The Ti content therefore should not exceed 0.05 wt%.

Al is an element which is added to prevent oxidation of elements such as Ti, Nb and B which are added to the molten steel. In order to sufficiently deoxidize the molten steel, it is necessary that the Al is added in an amount which is not smaller than 0.01 wt%. On the other hand, addition of Al in excess of 0.1 wt% causes a rise in the cost. The Al content, therefore, should be not smaller than 0.01 wt% and not greater than 0.1 wt%.

Nb and B are elements which are effective in preventing softening of steel sheet at high temperature. This advantageous effect is obtained only when both Nb and B coexist. In order to attain appreciable effect in preventing softening at high temperature, the Nb content should not be smaller than 0.005 wt% and the B content should not be smaller than 0.0002 wt%. However, addition of Nb in excess of 0.015 wt% undesirably reduces the ductility of the steel sheet at normal temperature, thus impairing press-workability. On the other hand, any B content exceeding 0.002 wt% causes a reduction in the Lankford value r which is an index of deep-drawability in press work, thus impairing press-workability. The Nb and B contents, therefore, are limited to be from 0.005 to 0.015 wt% and from 0.0002 to 0.002 wt%, respectively.

Si is an element which is effective in strengthening the steel and is added in accordance with the demand for strengthening. Addition of Si in excess of 0.1 wt%, however, adversely affects the deep-drawability and elongation so that Si content is determined to be not greater than 0.1 wt%.

Mn also is an element which strengthen the steel. The Mn content, however, is limited to be not greater than 1.0 wt%, because Mn content exceeding 1.0 wt% undesirably reduces deep-drawability.

A cold-rolled steel with the contents of components controlled as described above exhibits superior press-workability when annealed by being reheated to a temperature ranging between 770° and 900° C. When the annealing temperature is below 770° C., it is impossible to obtain sufficient recrystallization effect. On the other hand, when the annealing temperature exceeds 900° C., a transformation takes place to reduce the Lankford value r, thus causing reduction in ductility. The annealing temperature, therefore, should be determined to be from 770° C. to 900° C.

The rate of cooling of the annealed cold-rolled steel sheet before entering a molten zinc bath should be 10°C./sec. This cooling rate causes a moderate level of internal stress to be generated in the steel sheet, thus imparting greater resistance to softening of the portions of the steel sheet thermally affected during spot welding.

In order to enhance this advantageous effect, it is preferred that the cooling be conducted at a rate which is 20°C./sec or greater.

The cooling at such a fast rate, i.e., quenching, is ceased when the steel sheet is dipped in the molten zinc bath. It is necessary that the steel sheet is cooled to 530° C. at the highest before entering the molten zinc bath. On the other hand, cooling down below a lower limit temperature of 380° C. causes plating failure.

The Al content in the bath is not a factor which directly affects the spot-weldability, but produces an effect to effectively suppress exfoliation or peeling of the plating layer during the press work particularly when the Fe content of the plating layer is comparatively large. More specifically, it is possible to obtain a resistance to exfoliation or peeling of the plating layer during press work, high enough to enable the plated steel sheet to be used as an automotive body part when the Fe content of the plating layer ranges between 9 and 12 wt%, provided that the Al content in the plating bath is 0.13 wt% or more, and preferably is equal to or higher than 0.15 wt%.

It is a critical feature of the present invention that the plating layer has an Fe content not smaller than 9 wt%. When the Fe content is below 9 wt%, it is impossible to obtain the required spot-weldability even when the contents of the components of the base steel sheet are controlled as specified above. This is attributed to the fact that Fe content below 9 wt% undesirably allows presence of $\eta$ phase of low melting point in the plating layer so as to seriously promote the consumption of the spot welding electrode. On the other hand, any Fe content in the plating layer exceeding 12 wt% reduces the resistance to exfoliational peeling of the plating layer during press work, tending to cause a phenomenon known as "powdering". For these reasons, the Fe content in the plating layer is limited to be from 9 wt% to 12 wt%.

EXAMPLES

Practical examples of the invention will be described hereinunder. Hot dip galvanizing was conducted on each of the steel sheets (0.7 mm thick) having compositions as shown in Table 1, followed by galvannealing. Plating characteristics (anti-powdering in relation to Fe content ( wt%) in plating layer), press-workability (mechanical properties, in particular elongation El and Lankford value r) and spot-weldability (number of spots welded continuously) were examined and the results are shown in Table 2 together with the annealing and plating conditions.

From Table 2, it will be understood that the galvannealed steel sheet prepared in accordance with the present invention is excellent in all aspects of anti-powdering, press-workability and spot-weldability characteristics.

The Fe content in the plating layer was measured by dissolving the plating layer in an acid and measuring the Fe content by atomic spectral absorption.

The anti-powdering characteristic was measured by bending the plated steel sheet at 90°, straightening it again, applying an adhesive tape to the plating layer exfoliated, and subjecting the exfoliated plating layer on the tape to a fluorescent X-ray analysis so as to measure the number of the X-rays peculiar to zinc per second (Zn cps). the anti-powdering characteristic was then evaluated in the following five ranks.

| Evaluation ranks | Zn cps |
|---|---|
| 1 | <2000 |
| 2 | 2001 to 4000 |
| 3 | 4001 to 6000 |
| 4 | 6001 to 10000 |
| 5 | >10001 |

The spot-weldability was measured by counting the number of spots welded continuously under the following welding conditions.

| | |
|---|---|
| Welding electrode | |
| Type: | CF |
| Top end diameter: | 4.5 mm |
| Top end angle: | 120° |
| Outside diameter: | 13 mm |
| Material: | Cu—Cr |
| Welding Conditions | |
| Welding current: | 8.8 KA |
| Period of current supply: | 0.2 second (at 50 Hz) |
| Pressing force: | 170 kgf |
| Pressing conditions | |
| Before supply of current: | 0.6 second (at 50 Hz) |
| After supply of current: | 0.14 second (at 50 Hz) |

The evaluation of the spot-weldability was made in the following four ranks a, b, c and d in terms of the number of spots continuously welded to nugget diameters not smaller than $4\sqrt{t}$, where t (mm) represents the sheet thickness.

| Evaluation | Number of welding spots |
|---|---|
| a | 3000 or more |

-continued

| Evaluation | Number of welding spots |
|---|---|
| b | 2000 to 3000 |
| c | 1000 to 2000 |
| d | 1000 or less |

As will be understood from the foregoing description, according to the present invention, it is possible to produce a galvannealed steel sheet which is superior in press-workability, anti-powdering characteristic and spot-weldability, thus offering an anti-rust steel sheet suitable for use as automotive body parts.

TABLE 1

| Steel Type | C | Si | Mn | P | S | Al | Ti | Nb | N | B |
|---|---|---|---|---|---|---|---|---|---|---|
| A | 0.001 | 0.031 | 0.06 | 0.009 | 0.005 | 0.06 | 0.03 | 0.010 | 0.003 | 0.0004 |
| B | 0.002 | 0.029 | 0.07 | 0.007 | 0.004 | 0.08 | 0.02 | 0.008 | 0.002 | 0.0009 |
| C | 0.004 | 0.043 | 0.08 | 0.011 | 0.006 | 0.03 | 0.009 | 0.012 | 0.003 | 0.0006 |
| D | 0.003 | 0.035 | 0.07 | 0.008 | 0.005 | 0.06 | 0.02 | 0.011 | 0.003 | — |

TABLE 2

| | | Anneal Condition | | Plating condition | | | | Fe content | | | Mechanical properties | | | |
|---|---|---|---|---|---|---|---|---|---|---|---|---|---|---|
| | Material | Temp. °C. | Cooling rate °C./sec | Bath temp. °C. | Steel temp °C. | Al % in bath | Plating amount g/m² | in plating layer Fe % | Anti-powdering | Spot weldability | YS (kg/m m²) | YS (kg/m m²) | El (%) | r |
| 1 | A | 780 | 15 | 470 | 500 | 0.10 | 45-50 | 14.1 | 3 | b | 17 | 30 | 48 | 1.7 |
| 2 | B | 750 | 15 | 470 | 470 | 0.13 | 45-50 | 11.8 | 1 | c | 24 | 36 | 27 | 1.0 |
| 3 | D | 820 | 15 | 470 | 480 | 0.12 | 45-50 | 12.8 | 2 | d | 16 | 30 | 47 | 1.8 |
| 4 | D | 810 | 15 | 470 | 510 | 0.16 | 45-50 | 8.5 | 1 | d | 16 | 30 | 47 | 1.8 |
| 1 | A | 820 | 20 | 470 | 480 | 0.14 | 45-50 | 10.8 | 1 | a | 16 | 30 | 48 | 1.8 |
| 2 | A | 840 | 20 | 470 | 480 | 0.14 | 45-50 | 11.6 | 1 | a | 16 | 30 | 48 | 1.8 |
| 3 | A | 870 | 20 | 470 | 480 | 0.14 | 45-50 | 12.0 | 1 | a | 15 | 29 | 48 | 1.8 |
| 4 | A | 790 | 20 | 470 | 490 | 0.14 | 45-50 | 11.2 | 1 | a | 17 | 31 | 47 | 1.6 |
| 5 | B | 780 | 25 | 470 | 450 | 0.16 | 45-50 | 10.9 | 1 | a | 17 | 31 | 47 | 1.7 |
| 6 | B | 900 | 25 | 470 | 450 | 0.16 | 45-50 | 9.8 | 1 | a | 14 | 29 | 52 | 2.0 |
| 7 | B | 880 | 25 | 470 | 420 | 0.16 | 45-50 | 11.3 | 1 | a | 15 | 29 | 51 | 2.0 |
| 8 | B | 810 | 25 | 470 | 420 | 0.16 | 45-50 | 12.0 | 1 | a | 16 | 30 | 48 | 1.7 |
| 9 | C | 770 | 25 | 470 | 490 | 0.17 | 45-50 | 9.8 | 1 | a | 18 | 32 | 44 | 1.4 |
| 10 | C | 900 | 25 | 470 | 490 | 0.17 | 45-50 | 9.5 | 1 | a | 14 | 29 | 51 | 2.1 |
| 11 | C | 810 | 25 | 470 | 520 | 0.17 | 45-50 | 10.4 | 1 | a | 16 | 30 | 48 | 1.8 |
| 12 | C | 830 | 25 | 470 | 500 | 0.17 | 45-50 | 11.0 | 1 | a | 15 | 30 | 49 | 1.7 |

What is claimed is:

1. A method of producing a galvannealed steel sheet having superior spot-weldability characteristics, comprising the steps of: in a conventional cold rolling line, producing a cold rolled steel sheet containing 0.005 wt% or less of C. 0.005 to 0.05 wt% of Ti, 0.01 to 0.1 wt% of Al, 0.005 to 0.015 wt% of Nb and 0.0002 to 0.002 wt% of B, annealing said steel sheet at a temperature ranging between 770° and 900° C.; rapidly cooling the annealed steel sheet to a temperature ranging between 380° C. and 530° C. at a cooling rate of 10°C./sec or more; in a continuous hot-dip galvanizing process, dipping said steel sheet into a galvanizing bath having an Al content of 0.13 wt% or more so as to form a galvanized sheet; and subjecting said sheet to a heat-treatment to obtain an galvannealed sheet whose Fe content of the surface layer ranges between 9 and 12 wt%.

2. A method of producing a galvannealed steel sheet according to claim 1, wherein said cold rolled steel sheet consists 0.005 wt% or less of C, 0.005 to 0.05 wt% of Ti, 0.01 to 0.1 wt% of Al, 0.005 to 0.015 wt% of Nb and 0.0002 to 0.002 wt% of B, not more than 0.1 wt% of Si, not more than 0.1 wt% of Mn and the balance substantially Fe and inevitable impurities.

* * * * *